US008947341B2

(12) United States Patent
Zhao et al.

(10) Patent No.: US 8,947,341 B2
(45) Date of Patent: Feb. 3, 2015

(54) LIQUID CRYSTAL DISPLAY AND PIXEL DISPLAYING STRUCTURE THEREOF

(75) Inventors: Dengxia Zhao, Guangdong (CN); Poshen Lin, Guangdong (CN); Chiayin Hung, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 102 days.

(21) Appl. No.: 12/999,327

(22) PCT Filed: Sep. 11, 2010

(86) PCT No.: PCT/CN2010/076818

§ 371 (c)(1),
(2), (4) Date: Dec. 16, 2010

(87) PCT Pub. No.: WO2012/022055

PCT Pub. Date: Feb. 23, 2012

(65) Prior Publication Data

US 2012/0176427 A1 Jul. 12, 2012

(30) Foreign Application Priority Data

Aug. 17, 2010 (CN) ..... 2010 1 0260285

(51) Int. Cl.
*G09G 3/36* (2006.01)
*G09G 3/20* (2006.01)

(52) U.S. Cl.
CPC ..... *G09G 3/3611* (2013.01); *G09G 3/2074* (2013.01)
USPC ..... 345/102; 345/690; 345/694; 345/204; 345/205

(58) Field of Classification Search
CPC ..... G09G 3/3406; G09G 2320/0646; G09G 2360/16; G09G 2330/021; G09G 2320/064
USPC ..... 345/87–88, 102, 690, 694, 204–205
See application file for complete search history.

(56) References Cited

U.S. PATENT DOCUMENTS

| | | | | |
|---|---|---|---|---|
| 7,593,069 | B2 | 9/2009 | Oh et al. | |
| 2003/0169247 | A1 * | 9/2003 | Kawabe et al. | 345/204 |
| 2007/0273628 | A1 | 11/2007 | Sato et al. | |
| 2008/0266225 | A1 * | 10/2008 | Kim | 345/88 |

FOREIGN PATENT DOCUMENTS

| | | | |
|---|---|---|---|
| CN | 1866117 | A | 11/2006 |
| CN | 101000439 | A | 7/2007 |
| CN | 101079239 | | 11/2007 |
| CN | 101566744 | A | 10/2009 |
| JP | 2009103819 | A | 5/2009 |

* cited by examiner

*Primary Examiner* — Shaheda Abdin
(74) *Attorney, Agent, or Firm* — Mark M. Friedman

(57) ABSTRACT

The present invention provides a liquid crystal display and pixel displaying structure thereof. The pixel displaying structure has a plurality of sub-pixel units. The sub-pixel units are arranged on a two-dimensional matrix arrangement and each of the sub-pixel units is divided into two rectangular partitions, and each of the partitions performs a bright mode or a dark mode, and then the bright mode and the dark mode are changed over to each other between consecutive frames of screen while two transversely-adjacent or longitudinally-adjacent partitions are a combination of a bright-mode partition and a dark-mode partition. Therefore, ladder-like bright-dark boundary line appearing during displaying oblique lines can be reduced based on the visual mixture of brightness interchanging.

19 Claims, 5 Drawing Sheets

LIQUID CRYSTAL DISPLAY AND PIXEL DISPLAYING STRUCTURE THEREOF

FIELD OF THE INVENTION

The present invention relates to a liquid crystal display and a pixel displaying structure thereof, and more particularly to a liquid crystal display and pixel displaying structure thereof that use image brightness mixture between two consecutive frames to reduce zigzag phenomenon of bright-dark boundaries that is derived from using pixel-division means for solving color-shift problem.

BACKGROUND OF THE INVENTION

Because liquid crystal displays have a characteristic of color-shift phenomenon that comes along with the increase in view angle, and therefore reducing the color-shift problem has become one of the chief targets to achieve high quality liquid crystal displays. Referring to FIG. 1, FIG. 1 discloses a scheme view of a pixel displaying structure of a conventional liquid crystal display, wherein the liquid crystal display has a plurality of sub-pixel units 90, and the sub-pixel units 90 are arranged in a two-dimensional matrix arrangement, and at least one sub-pixel units 90 constructs a pixel unit. Each of the sub-pixel units 90 is divided along a horizontal line into a rectangular bright-partition 90A and a rectangular dark-partition 90B, wherein the bright-partition 90A is not necessarily equal to the dark-partition in size, and the bright-partitions 90A of the sub-pixel unit 90 arranged at the same row are corresponding to each other in position, and similarly the dark-partitions 90B are corresponding to each other in position. The division is achieved by varying alignment direction of liquid crystal molecules under the bright-partition 90A and the dark-partition 90B to make light flux of the bright-partition 90A to be more than the light flux of the dark-partition 90B. In any view angle of the liquid crystal display, the brightness of mixture of lights from the bright-partitions 90A and the dark-partitions 90B will be basically the same as the brightness we feel when we look straight at the liquid crystal display, so as to solve the color-shift problem.

However, with reference to FIG. 2, FIG. 2 is a scheme view of the next frame of the pixel displaying structure of the conventional liquid crystal display in FIG. 1, wherein the bright-partition 90A of the preceding frame turns into a dark-partition 90A', and the dark-partition 90B of the preceding frame turns into a bright-partition 90B', in other words, brightness and darkness change over between the rows of sub-pixel units on two consecutive frames of screen image. Foregoing means of changing over brightness and darkness between the rows of sub-pixel units will inevitably affect image quality during displaying an oblique line on screen due to the boundary between the bright-partition 90A and the dark-partition 90B of the sub-pixel unit 90, wherein a user will see a ladder-like (or zigzag) bright-dark boundary line 900 appearing on the oblique line constructed by a plurality of the sub-pixel units 90.

Hence, it is necessary to provide a liquid crystal display and a pixel displaying structure thereof to overcome the problems existing in the conventional technology.

SUMMARY OF THE INVENTION

A primary object of the invention is to provide a liquid crystal display, wherein the pixel displaying structure thereof uses image brightness mixture between two consecutive frames to reduce ladder-like phenomenon of bright-dark boundaries that is derived from using pixel-division means for improving color-shift problem.

A secondary object of the present invention is to provide a pixel displaying structure which changes over bright mode and dark mode at the partition of each sub-pixel unit between two consecutive frames while keeping the bright-dark mode diverse between two of the adjacent partitions, so as to use changing-over on brightness to reduce the ladder-like bright-dark boundary line which occurred while displaying an oblique line on screen on the basis of visible persistence theory.

To achieve the above object, the present invention provides a liquid crystal display, wherein the liquid crystal display comprises:

a display panel having a pixel displaying structure, wherein the pixel displaying structure has a plurality of sub-pixel units arranged on a two-dimensional matrix arrangement, and each of the sub-pixel unit is divided into two rectangular partitions;

a liquid crystal driving module connected to the sub-pixel units; and a timing controller connected to the liquid crystal driving module, wherein the timing controller controls the liquid crystal driving module to drive each of the partitions to perform a bright mode or a dark mode in one frame, and then change over the bright-mode partition to the dark-mode partition or change over the dark-mode partition to the bright-mode partition in next frame, wherein each of the partitions differs with the partitions adjacent thereto on the bright mode and the dark mode.

In one embodiment of the present invention, the timing controller controls the liquid crystal driving module to transfer driving signals with opposite polarities to the same sub-pixel unit between two consecutive frames.

In one embodiment of the present invention, the liquid crystal driving module has a data driver and a gate driver, wherein the data driver is connected to the sub-pixel units through a plurality of data lines which are extended along a column direction, and the gate driver is connected to the sub-pixel units through a plurality of scan lines which are extended along a row direction.

In one embodiment of the present invention, two of the adjacent sub-pixel units in the same row are both connected to one of the data lines.

In one embodiment of the present invention, the liquid crystal display further has a backlight module, wherein the backlight module is mounted at a side of the display panel to provide a light source for the display panel.

Furthermore, the present invention provides a pixel displaying structure which has a plurality of sub-pixel units arranged on a two-dimensional matrix arrangement, and each of the sub-pixel unit is divided into two rectangular partitions, wherein each of the partitions performs a bright mode or a dark mode in one frame, and then the bright mode and the dark mode are changed over to each other in next frame, wherein each of the partitions differs with the partitions adjacent thereto on bright-dark mode.

In one embodiment of the present invention, the pixel displaying structure controls a liquid crystal driving module through a timing controller to drive each of the sub-pixel units.

In one embodiment of the present invention, the timing controller controls the liquid crystal driving module to transfer driving signals with opposite polarities to the same sub-pixel unit between two consecutive frames.

In one embodiment of the present invention, the liquid crystal driving module has a data driver and a gate driver, wherein the data driver is connected to the sub-pixel units through a plurality of data lines which are extended along a column direction, and the gate driver is connected to the sub-pixel units through a plurality of scan lines which are extended along a row direction.

In one embodiment of the present invention, two of the adjacent sub-pixel units in the same row are both connected to one of the data lines.

Comparing with the existing techniques, the liquid crystal display and the pixel displaying structure thereof of the present invention change over the bright-dark mode of each of the partitions of the sub-pixel units between two consecutive frames while keeping the bright-dark mode diverse between two of the adjacent partitions to mix the brightness visually for reducing the ladder-like bright-dark boundaries when displaying oblique lines on screen, so as to enhance image qualities.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 1:
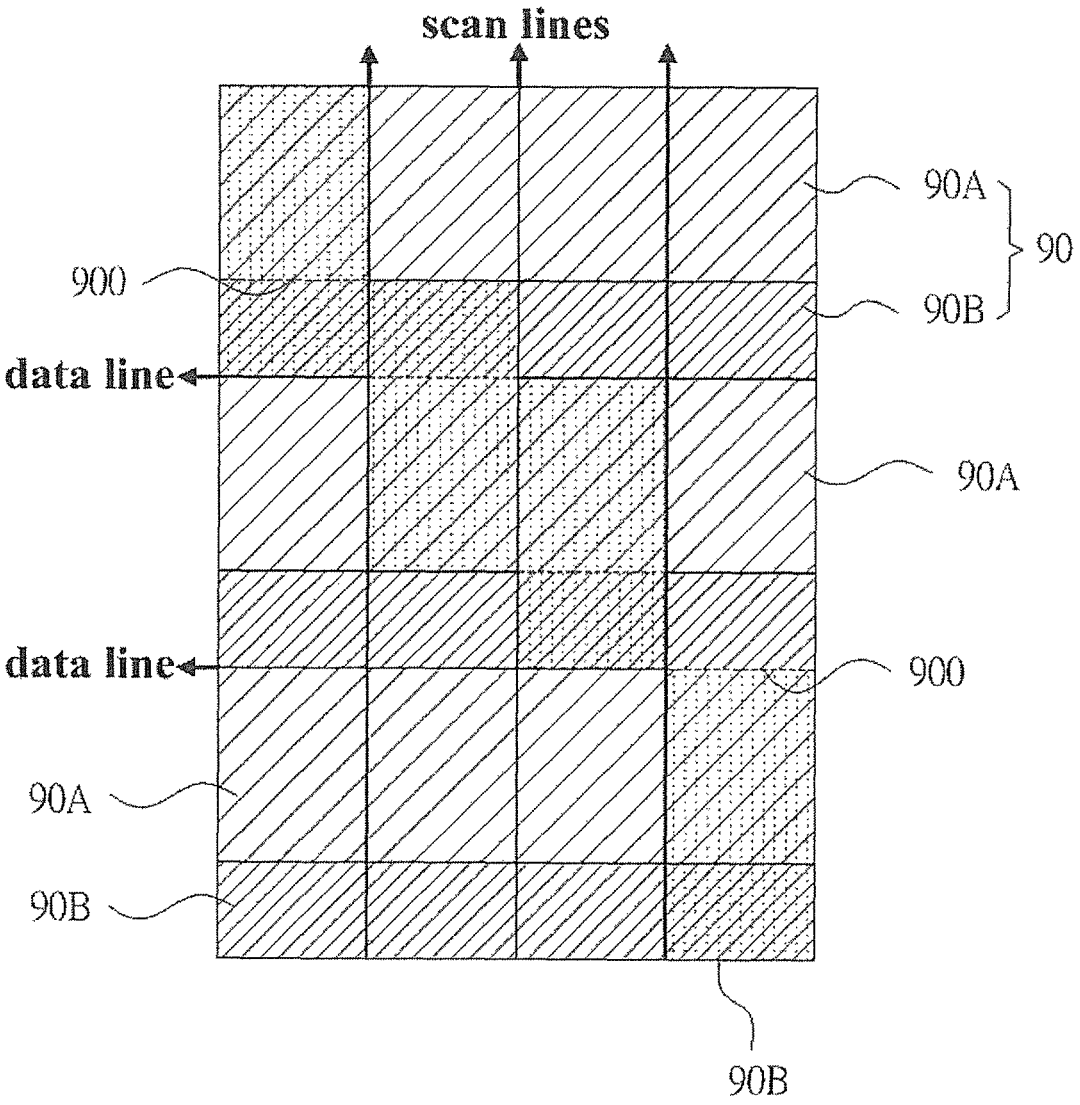
Fig.1 PRIOR ART
FIG. 1 is a schematic view of a conventional pixel displaying structure applying pixel-division for improving a color-shift problem.
Figure 2:
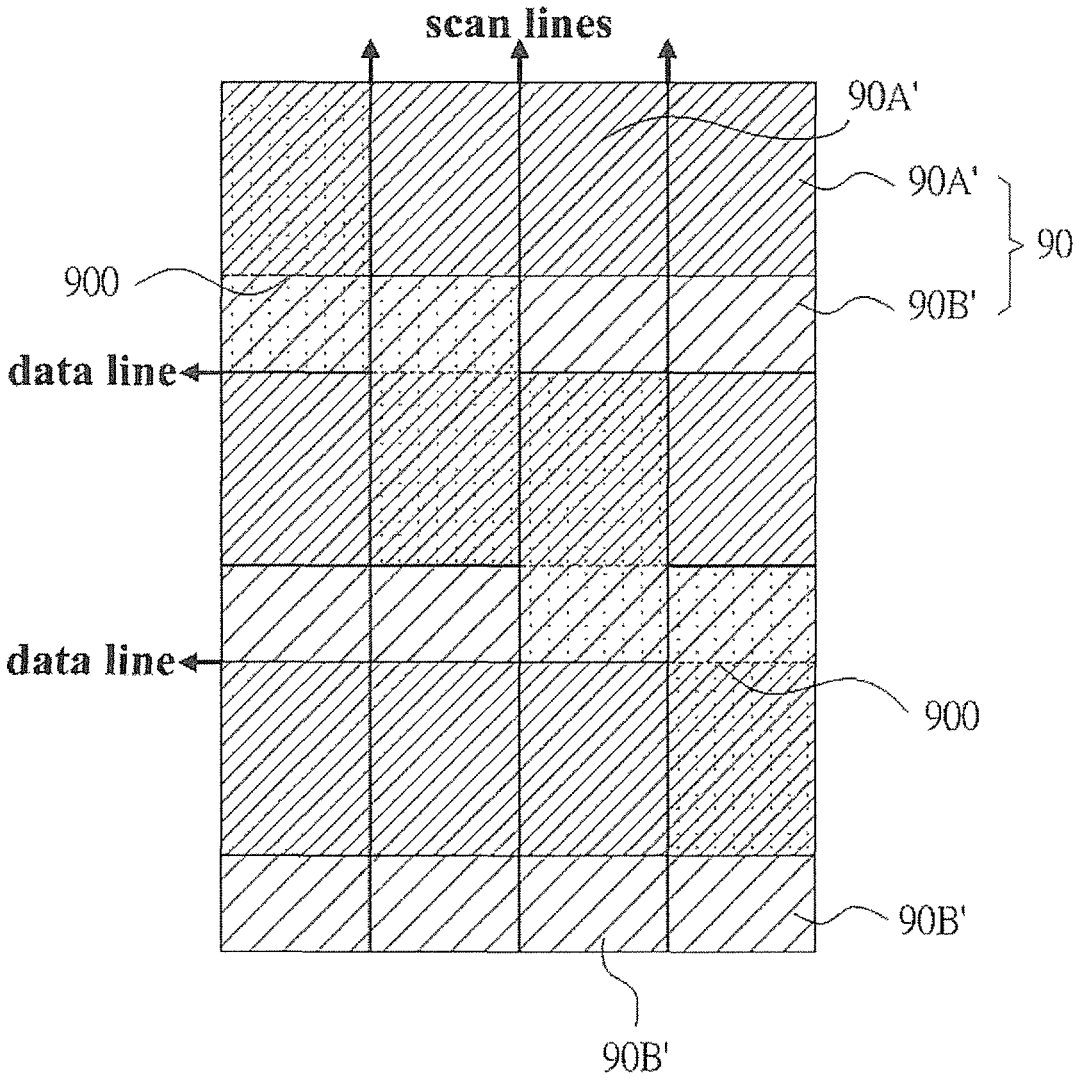
Fig.2 PRIOR ART
FIG. 2 is a schematic view of a next frame of the pixel displaying structure in FIG. 1.
Figure 3:
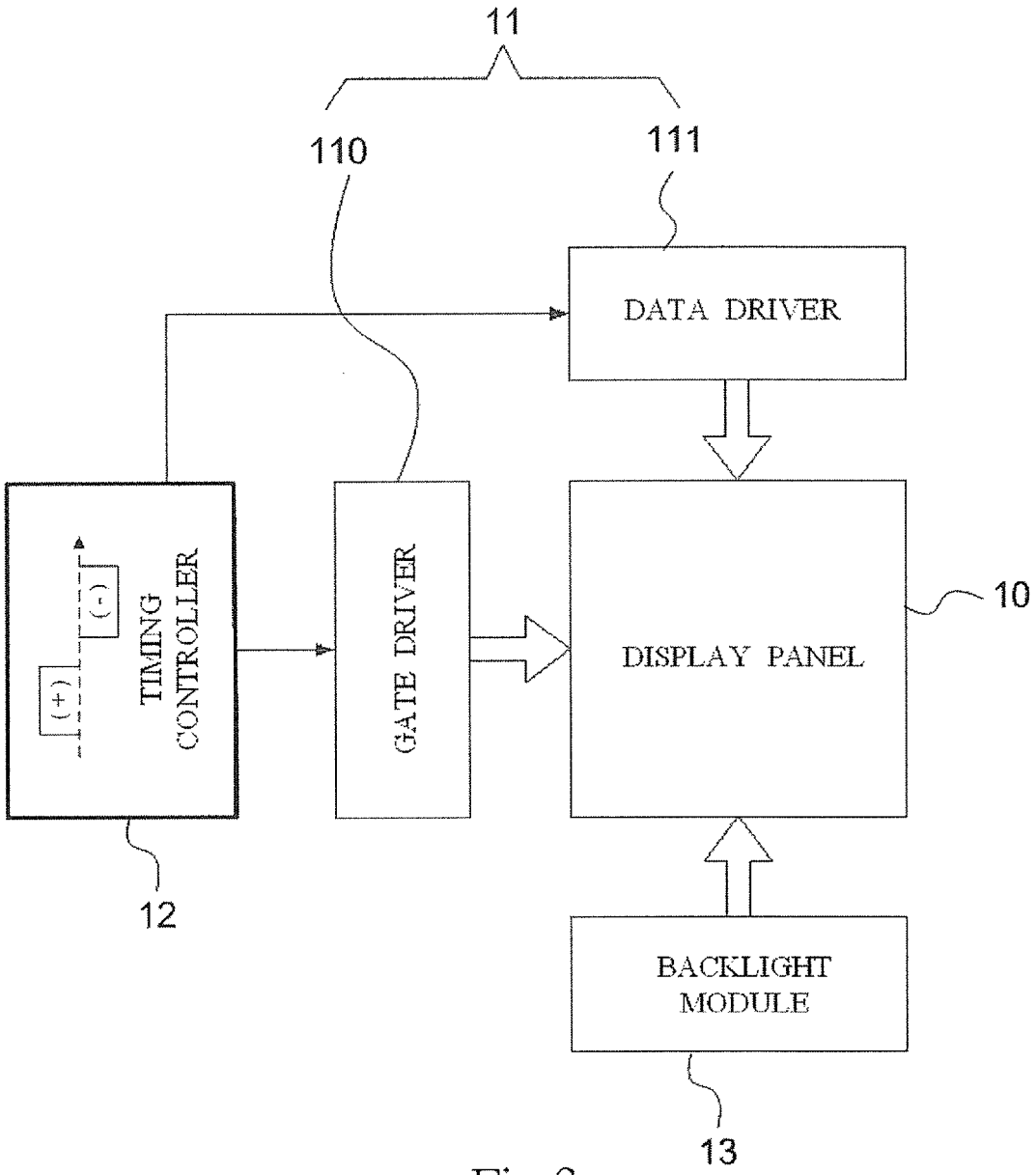
FIG. 3 is a system schematic view of a liquid crystal display according to a preferred embodiment of the present invention.

With reference to FIG. 3, FIG. 3 discloses a system schematic view of a liquid crystal display according to a preferred embodiment of the present invention. A liquid crystal display (LCD) comprises a display panel 10, a liquid crystal driving module 11, a timing controller (T-con) 12 and a backlight module 13.

Figure 4:
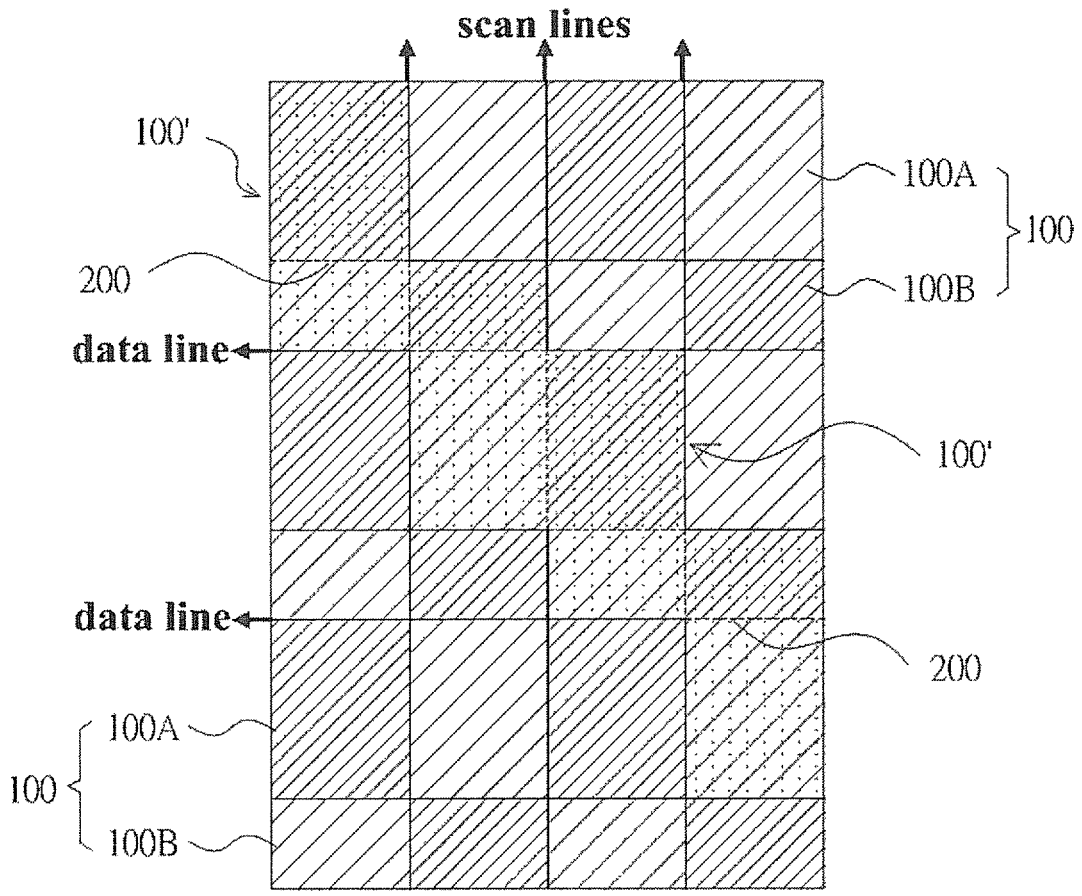
FIG. 4 is a schematic view of a pixel displaying structure according to a preferred embodiment of the present invention.

The display panel 10 has a pixel displaying structure, with further reference to FIG. 4, wherein FIG. 4 discloses a schematic view of the pixel displaying structure according to a preferred embodiment of the present invention, and the pixel displaying structure has a plurality of sub-pixel units 100 which are arranged on a two-dimensional matrix arrangement. One pixel unit may be constructed by at least one of the sub-pixel units 100. Each of the sub-pixel units 100 is divided into two rectangular partitions, a first partition 100A and a second partition 100B, wherein the first partition 100A and the second partition 100B is not necessarily equal to each other in dimension. The sub-pixel units 100 generally refer to thin film transistors.

The liquid crystal driving module 11 is connected to the sub-pixel units 100 and preferably has a gate driver 110 and a data driver 111 (i.e. source driver). The data driver 110 is connected to the sub-pixel units 100 through a plurality of data lines which are extended along a row direction, and the gate driver 111 is connected to the sub-pixel units 100 through a plurality of scan lines which are extended along a column direction, and the scan lines cross the data lines. Arrangement directions of the data driver 110 and the gate driver 111 are basically interchangeable. Besides, in the sub-pixel units 100 arranged on a two-dimensional matrix arrangement, two of the adjacent sub-pixel units 100 in the same row may be both connected to one of the data lines as to form a so-called half source driving structure (HSD).

The timing controller 12 controls the liquid crystal driving module 11 to transfer driving signals with opposite polarities to the same sub-pixel unit 100 between two consecutive frames to further drive each of the partition to perform a bright mode or a dark mode in one frame, and then change over the bright-mode partition to the dark-mode partition or change over the dark-mode partition to the bright-mode partition in next frame, wherein each of the partitions differs with the partitions adjacent thereto on bright and dark modes.

Figure 5:
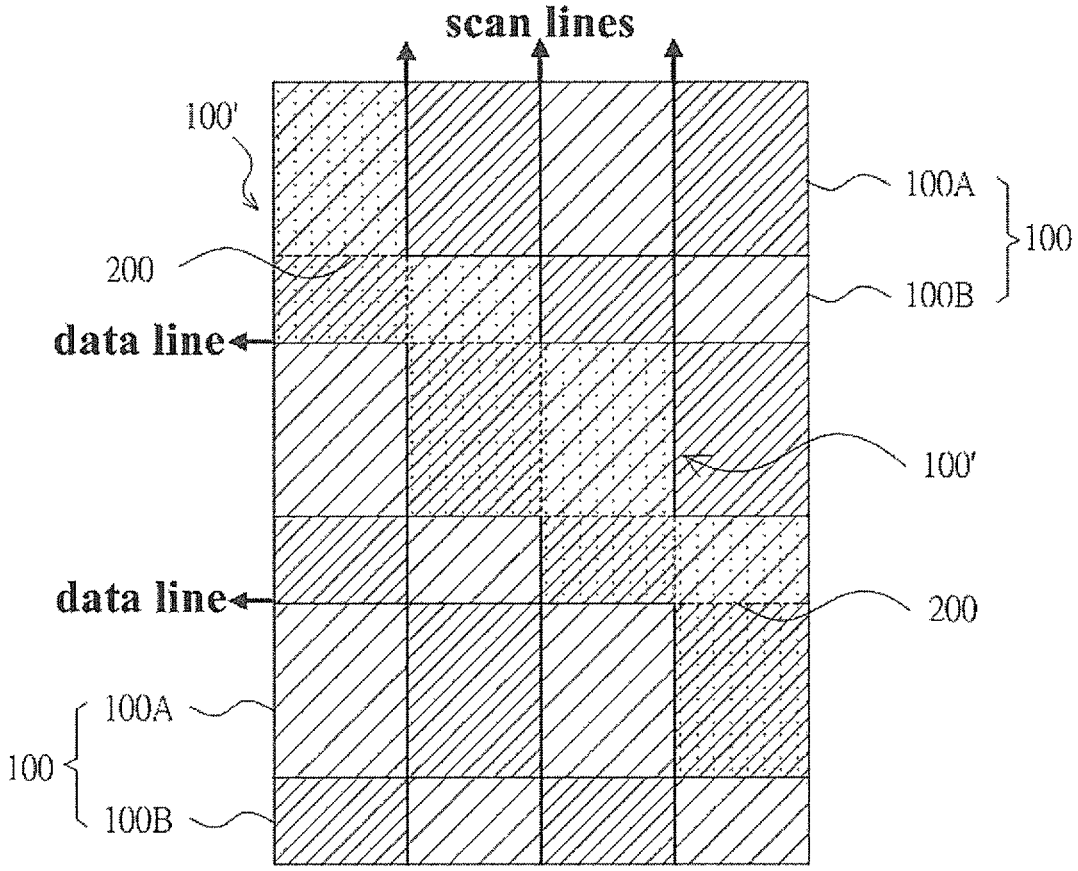
FIG. 5 is a schematic view of a next frame of the pixel displaying structure in FIG. 4.

In detail, with reference to FIGS. 4 and 5, FIG. 5 is a schematic view of a next frame of the pixel displaying structure in FIG. 4. Each of the sub-pixel units 100 is divided into two rectangular partitions, a first partition 100A and a second partition 100B. The first partition 100A and the second partition 100B perform a bright mode or a dark mode in one frame, wherein two of the transversely-adjacent first partitions 100A or two of the transversely-adjacent second partitions 100B perform bright-dark modes that differ with each other. Meanwhile, two longitudinally-adjacent first partition 100A and second partition 100B perform bright-dark modes that differ with each other. In the next frame, while the timing controller 12 controls the liquid crystal driving module 11 to transfer a driving signal with an opposite polarity to the same sub-pixel unit 100, wherein the first partitions 100A or the second partitions 100B in bright mode are changed over to dark mode, and the first partitions 100A or the second partitions 100B in dark mode are changed over to bright mode.

The backlight module 13 is mounted at a side of the display panel 10 to provide a light source for the display panel 10.

With reference to FIGS. 4 and 5, when some of the sub-pixels 100' are constructing an oblique line, since the bright-dark mode of the partitions of the sub-pixels 100 change over between two consecutive frames while maintaining each of the partitions differs with the partitions adjacent thereto on bright-dark mode, image brightness on the consecutive frames will be mixed due to vision persistence to further reduce a ladder-like line that is visually produced by the bright-dark boundaries of the partitions, so as to achieve the effect of enhancing image qualities.

In conclusion, comparing with the conventional pixel displaying structure which improves the color-shift problem by pixel division to derive another problem of having a ladder-like bright-dark boundary line appeared during displaying an oblique line, the pixel displaying structure of the present invention in FIG. 3 that maintains each of the partitions differs with the partitions adjacent thereto on bright-dark mode and inverses the voltage polarity of each of the sub-pixels 100 by using the timing controller 12 to change over the bright-dark mode between consecutive frames indeed effectively achieve brightness mixture on two consecutive frames with vision persistence to reduce the ladder-like lines which are produced visually by the bright-dark boundaries of the partitions, and to enhance displaying qualities.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. A liquid crystal display, characterized in that: the liquid crystal display comprises:

a display panel having a pixel displaying structure, wherein the pixel displaying structure has a plurality of sub-pixel units arranged on a two-dimensional matrix arrangement, and each of the sub-pixel unit is divided into a first partition and a second partition;

a liquid crystal driving module connected to the sub-pixel units, wherein the liquid crystal driving module further has a data driver and a gate driver, wherein the data driver is connected to the sub-pixel units through a plurality of data lines which are extended along a column direction, and the gate driver is connected to the sub-pixel units through a plurality of scan lines which are extended along a row direction; and a timing controller connected to the liquid crystal driving module, wherein the timing controller controls the liquid crystal driving module to transfer driving signals with opposite polarities to the same sub-pixel unit between each two consecutive frames to drive each of the first partition and the second partition to perform a bright mode or a dark mode in each frame, wherein the first partition and the second partition of each of the sub-pixel units respectively perform the bright mode and the dark mode both alternated in the same one of each two consecutive frames, and each of the first partition and the second partition performs the bright mode and the dark mode both alternated upon each two consecutive frames; and wherein the first partition performs the bright mode in a current frame and then performs the dark mode in a next frame, and the second partition performs the dark mode in the current frame and then performs the bright mode in the next frame.

2. The liquid crystal display as claimed in claim 1, characterized in that: two of the adjacent sub-pixel units in the same row are both connected to one of the data lines.

3. The liquid crystal display as claimed in claim 2, characterized in that: the liquid crystal display further has a backlight module, wherein the backlight module is mounted at a side of the display panel to provide a light source for the display panel.

4. The liquid crystal display as claimed in claim 1, characterized in that: the liquid crystal display further has a backlight module, wherein the backlight module is mounted at a side of the display panel to provide a light source for the display panel.

5. A liquid crystal display, characterized in that: the liquid crystal display comprises:

a display panel having a pixel displaying structure, wherein the pixel displaying structure has a plurality of sub-pixel units arranged on a two-dimensional matrix arrangement, and each of the sub-pixel unit is divided into a first partition and a second partition;

a liquid crystal driving module connected to the sub-pixel units; and a timing controller connected to the liquid crystal driving module, wherein the timing controller controls the liquid crystal driving module to drive each of the first partition and the second partition to perform a bright mode or a dark mode in each frame, wherein the first partition and the second partition of each of the sub-pixel units respectively perform the bright mode and the dark mode both alternated in the same one of each two consecutive frames, and each of the first partition and the second partition performs the bright mode and the dark mode both alternated upon each two consecutive frames; and wherein the first partition performs the bright mode in a current frame and then performs the dark mode in a next frame, and the second partition performs the dark mode in the current frame and then performs the bright mode in the next frame.

6. The liquid crystal display as claimed in claim 5, characterized in that: the timing controller controls the liquid crystal driving module to transfer driving signals with opposite polarities to the same sub-pixel unit between each two consecutive frames.

7. The liquid crystal display as claimed in claim 6, characterized in that: the liquid crystal display further has a backlight module, wherein the backlight module is mounted at a side of the display panel to provide a light source for the display panel.

8. The liquid crystal display as claimed in claim 5, characterized in that: the liquid crystal driving module further has a data driver and a gate driver, wherein the data driver is connected to the sub-pixel units through a plurality of data lines which are extended along a column direction, and the gate driver is connected to the sub-pixel units through a plurality of scan lines which are extended along a row direction.

9. The liquid crystal display as claimed in claim 8, characterized in that: two of the adjacent sub-pixel units in the same row are both connected to one of the data lines.

10. The liquid crystal display as claimed in claim 9, characterized in that: the liquid crystal display further has a backlight module, wherein the backlight module is mounted at a side of the display panel to provide a light source for the display panel.

11. The liquid crystal display as claimed in claim 8, characterized in that: the liquid crystal display further has a backlight module, wherein the backlight module is mounted at a side of the display panel to provide a light source for the display panel.

12. The liquid crystal display as claimed in claim 5, characterized in that: the liquid crystal display further has a backlight module, wherein the backlight module is mounted at a side of the display panel to provide a light source for the display panel.

13. A pixel displaying structure, characterized in that: the pixel displaying structure has a plurality of sub-pixel units arranged on a two-dimensional matrix arrangement, and each of the sub-pixel unit is divided into a first partition and a second partition , wherein the first partition and the second partition of each of the sub-pixel units respectively perform a bright mode and a dark mode both alternated in the same one of each two consecutive frames, and each of the first partition and the second partition performs the bright mode and the dark mode both alternated upon each two consecutive frames; and wherein the first partition performs the bright mode in a current frame and then performs the dark mode in a next frame, and the second partition performs the dark mode in the current frame and then performs the bright mode in the next frame.

14. The pixel displaying structure as claimed in claim 13, characterized in that:

the pixel displaying structure controls a liquid crystal driving module through a timing controller to drive each of the sub-pixel units.

15. The pixel displaying structure as claimed in claim 14, characterized in that: the timing controller controls the liquid crystal driving module to transfer driving signals with opposite polarities to the same sub-pixel unit between each two consecutive frames.

16. The pixel displaying structure as claimed in claim 15, characterized in that:

the liquid crystal driving module has a data driver and a gate driver, wherein the data driver is connected to the sub-pixel units through a plurality of data lines which are extended along a column direction, and the gate driver is connected to the sub-pixel units through a plurality of scan lines which are extended along a row direction.

17. The pixel displaying structure as claimed in claim 16, characterized in that:

two of the adjacent sub-pixel units in the same row are both connected to one of the data lines.

18. The pixel displaying structure as claimed in claim 14, characterized in that:

the liquid crystal driving module has a data driver and a gate driver, wherein the data driver is connected to the sub-pixel units through a plurality of data lines which are extended along a column direction, and the gate driver is connected to the sub-pixel units through a plurality of scan lines which are extended along a row direction.

19. The pixel displaying structure as claimed in claim 18, characterized in that:

two of the adjacent sub-pixel units in the same row are both connected to one of the data lines.

* * * * *